US008142340B2

(12) United States Patent
Mantzivis

(10) Patent No.: US 8,142,340 B2
(45) Date of Patent: Mar. 27, 2012

(54) BAG AND A METHOD OF FORMING A BAG

(76) Inventor: Lionel Nicholas Mantzivis, Bedford View (ZA)

( * ) Notice: Subject to any disclaimer, the term of this patent is extended or adjusted under 35 U.S.C. 154(b) by 1472 days.

(21) Appl. No.: 10/532,566

(22) PCT Filed: Oct. 24, 2003

(86) PCT No.: PCT/ZA03/00157

§ 371 (c)(1),
(2), (4) Date: Nov. 21, 2005

(87) PCT Pub. No.: WO2004/037663

PCT Pub. Date: May 6, 2004

(65) Prior Publication Data

US 2006/0233466 A1 Oct. 19, 2006

(30) Foreign Application Priority Data

Oct. 24, 2002 (ZA) ..... 02/8595

(51) Int. Cl.
*B65D 33/06* (2006.01)

(52) U.S. Cl. ..... 493/88; 493/221; 493/926; 383/6; 383/10; 383/17; 383/31; 53/134.1

(58) Field of Classification Search ..... 493/88, 493/221, 226, 926; 383/6, 7, 10, 17, 18, 383/31; 53/134.1
See application file for complete search history.

(56) References Cited

U.S. PATENT DOCUMENTS

| | | | | | |
|---|---|---|---|---|---|
| 1,524,399 | A * | 1/1925 | Krueger | 16/407 |
| 2,400,759 | A * | 5/1946 | Katz | 16/406 |
| 3,021,767 | A * | 2/1962 | Hamilton | 493/221 |
| 3,383,029 | A * | 5/1968 | Reade | 229/117.23 |
| 3,877,352 | A * | 4/1975 | Brieske | 493/199 |
| 4,539,705 | A * | 9/1985 | Baines | 383/21 |
| 4,691,368 | A * | 9/1987 | Roessiger | 383/10 |
| 4,867,575 | A * | 9/1989 | Wood | 383/17 |
| 5,059,034 | A * | 10/1991 | Schulz et al. | 383/21 |
| 5,102,383 | A * | 4/1992 | Achelpohl et al. | 493/226 |
| 5,121,995 | A * | 6/1992 | Newman et al. | 383/29 |
| 5,174,657 | A * | 12/1992 | Peppiatt | 383/8 |
| 7,585,007 | B2 * | 9/2009 | Johnson et al. | 294/152 |
| 2006/0188177 | A1 * | 8/2006 | Dyer et al. | 383/10 |
| 2007/0071370 | A1 * | 3/2007 | Schneider | 383/119 |

FOREIGN PATENT DOCUMENTS

WO WO 9104918 * 4/1991

* cited by examiner

*Primary Examiner* — Hemant M Desai
(74) *Attorney, Agent, or Firm* — Hahn Moodley LLP; Vani Moodley, Esq.

(57) ABSTRACT

A method of forming a bag is provided. The method includes providing an elongate tubular member (22) having opposed ends, at least one end (24) of which defines an open mouth (26). The method further includes folding opposed portions (28, 30, 32, 34) of the tubular member (22) to extend at least partially across the mouth (26). The method also includes positioning a panel (36) to extend across the opposed portions (28, 30, 32, 34). The method further includes securing the panel 36 and the opposed portions (28, 30, 32, 34) together thereby to close the mouth (26) at the at least one end (24) of the tubular member (22).

13 Claims, 5 Drawing Sheets

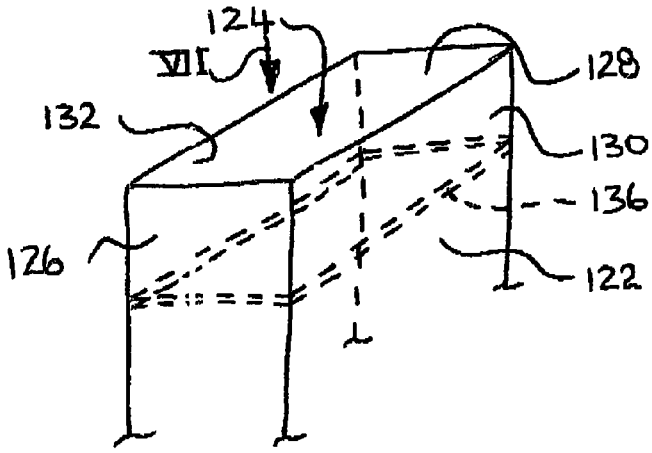
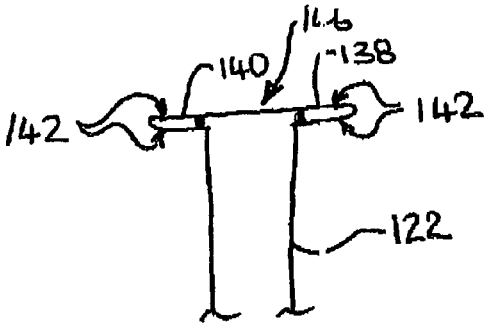
FIG 10
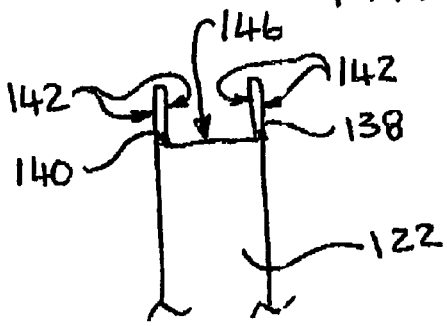
FIG 11
FIG 8
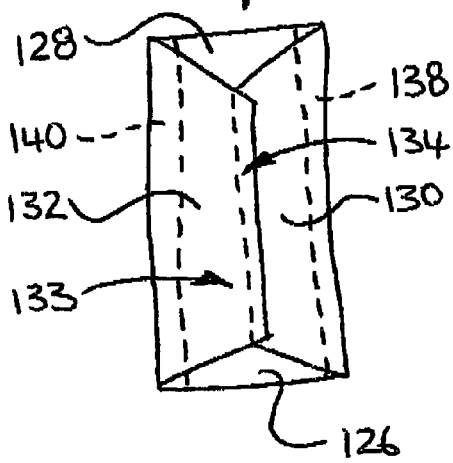
FIG 9

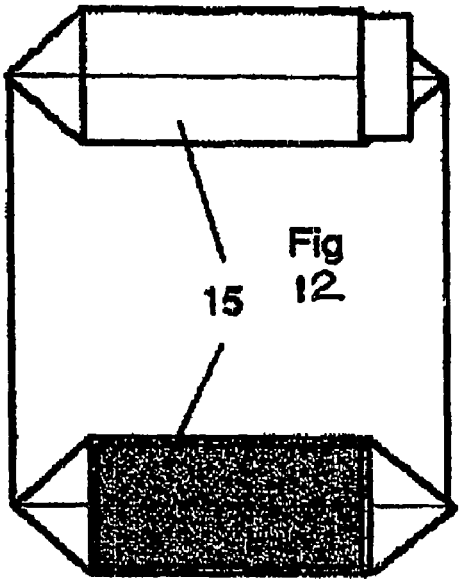
Fig 12
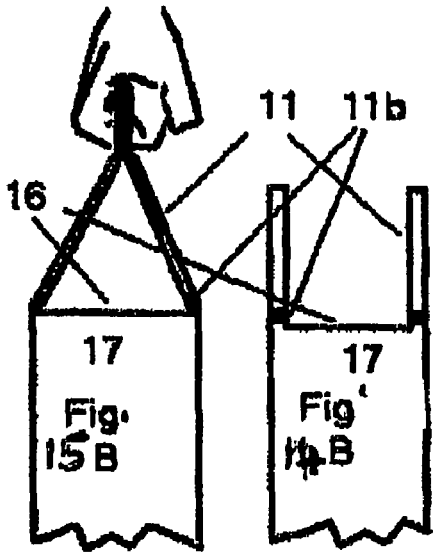
Fig. 15B
Fig 14B
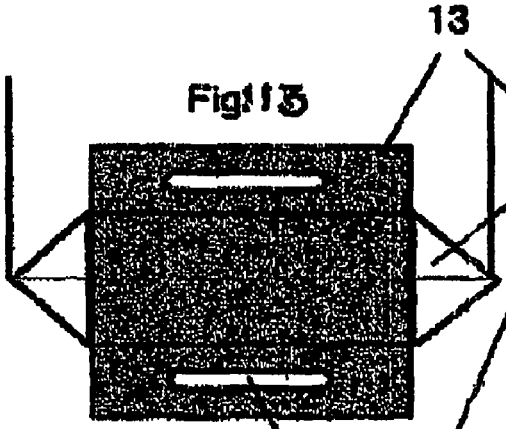
Fig 13
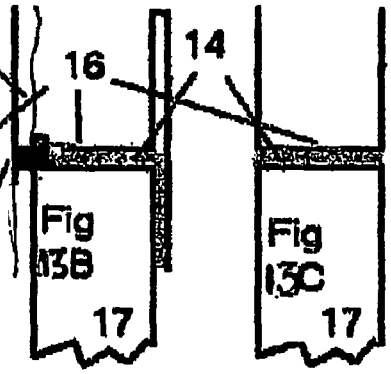
Fig 13B
Fig 13C
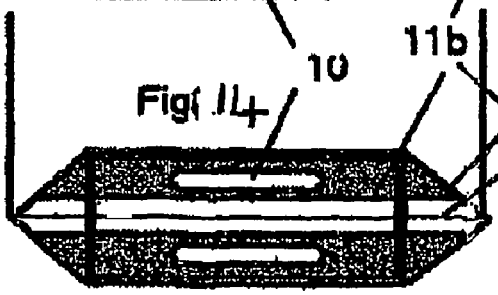
Fig 14
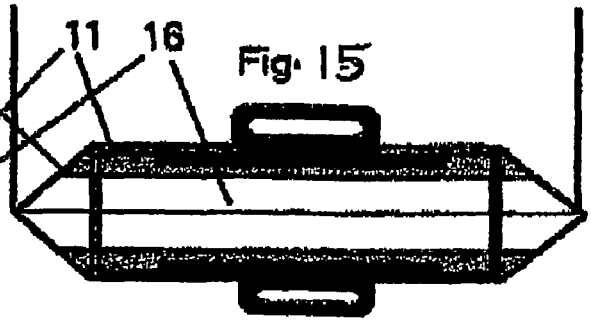
Fig. 15

BAG AND A METHOD OF FORMING A BAG

This application is being filed as a US National stage under 35 USC 371of PCT Application No. PCT/ZA03/00157, filed Oct. 24, 2003, which claimed priority to South African Application No. 02/8595 filed Oct. 24, 2002.

FIELD OF THE INVENTION

THIS INVENTION relates to bags. In particular, this invention relates to a method of forming a bag and to a bag.

BACKGROUND OF THE INVENTION

The packaging industry in South Africa is currently very competitive. As a result, manufacturers of bags, or packages, are seeking ways to enhance their products. Notably, in the field of the production of polyethylene and woven polypropylene bags, manufacturers are producing packaging systems including handles, which can be attached to and punched into the bags. The methods currently employed to manufacture such packaging systems and bags are laborious and ill suited for automatic production.

It is an object of this invention to provide a method of producing a bag which is better suited for automatic production of bags than the current methods used to produce bags of which the Applicant is aware.

It is believed that the method of forming a bag in accordance with the invention can advantageously be used to produce bags of the block bottom type and the block bottom valve type. It will be appreciated that the term "bags of the block bottom type" refers to bags having a generally rectangular shaped base. Such bags can be closed at both opposed ends and can have a rectangular shaped base at each end. The term "bags of the block bottom valve type" refers to bags which have a generally rectangular shaped base at one end and an open mouth at an opposed end. It will be appreciated that the invention is not limited to the production of such bags only, but can be used to form bags having bases of varying shapes, such as circular, oval, multi-sided and the like.

SUMMARY OF THE INVENTION

According to a first aspect of the invention, there is provided a method of forming a bag, the method including:

providing an elongate tubular member having opposed ends, at least one end of which defines an open mouth;

folding opposed portions of the tubular member to extend at least partially across the mouth;

positioning a panel to extend across the opposed portions; and securing the panel and the opposed portions together thereby to close the mouth at the at least one end of the tubular member.

The opposed portions may be first opposed portions and the method may further include folding other opposed portions of the tubular member across the panel such that the panel is sandwiched between the first opposed portions and the other opposed portions and securing the panel and the first and the other opposed portions together thereby to close the mouth at the at least one end of the tubular member.

Instead, the opposed portions may be first opposed portions and the method may further include folding other opposed portions of the tubular member to extend at least partially across the first opposed portions, positioning the panel to extend across the first and the other opposed portions and securing the panel and the first and the other opposed portions together thereby to close the mouth at the at least one end of the tubular member.

Securing the panel and the opposed portions together may include securing a first portion of the panel and the opposed portions together so as to define at least one free portion of the panel which is free of the opposed portions.

The method may further include forming an aperture in the at least one free portion of the panel thereby to define a handle.

Instead, securing a first portion of the panel and the opposed portions together may include securing a generally middle portion of the panel and the opposed portions together so as to define two opposed free portions of the panel which are free of the opposed portions.

The method may further include forming an aperture in each of the free portions of the panel thereby to define opposed handles.

The opposed portions of the tubular member may be folded along a fold line and the at least one free portion of the panel may extend beyond the fold line.

The method may further include securing the free portion of the panel to the tubular member beyond the fold line.

Securing the free portion of the panel to the tubular member beyond the fold line may include forming a cuff or hem formation.

The method may further include forming a handle on the cuff formation.

Forming the handle on the cuff formation may include forming an aperture in the cuff formation.

Instead, forming the handle on the cuff formation may include securing a handle member to the cuff formation.

The handle member may include a handle portion and opposed extension portions. Securing the handle member to the cuff formation may then include positioning the handle member such that the extension portions extend internally along the cuff formation.

The opposed portions of the tubular member may be folded along a fold line and each free portion of the panel may extend beyond the fold line.

The method may further include securing each free portion of the panel to the tubular member beyond the fold line.

Securing each free portion of the panel to the tubular member beyond the fold line may include forming opposed cuff formations.

The method may further include forming a handle on each cuff formation.

Forming the handle on each cuff formation may include forming an aperture in each cuff formation.

Forming the handle on each cuff formation may include securing a handle member to each hem formation.

Each handle member may include a handle portion and opposed extension portions. Securing a handle member to each cuff formation may include positioning each handle member such that the extension portions extend internally along the cuff formations.

According to another aspect of the invention, there is provided a bag including:

an elongate tubular member having at least one closed end;

opposed portions of the tubular member at the closed end, which opposed portions extend toward each other; and a panel secured to and extending across the opposed portions.

The opposed portions may be first opposed portions and the bag may further include other opposed portions of the tubular member which extend across the panel such that the panel is sandwiched between the first opposed portions and the other opposed portions.

Instead, the opposed portions may be first opposed portions and the bag may further include other opposed portions of the tubular member which extend at least partially across the first opposed portions. The panel may extend across the first and the other opposed portions.

The panel may include a first portion secured to the opposed portions of the tubular member and at least one free portion free of the opposed portions.

The bag may include an aperture in the at least one free portion of the panel to serve as a handle.

Instead, the panel may include a middle portion secured to the opposed portions of the tubular member and two opposed free portions free of the opposed portions.

The bag may further include an aperture in each free portion of the panel to serve as handles.

The opposed portions of the tubular member may be folded along a fold line and the at least one free portion of the panel may extend beyond the fold line and may be secured to the tubular member beyond the fold line.

The at least one free portion of the panel may be secured to the tubular member to define a hem or cuff formation.

The bag may further include a handle on the cuff formation.

The handle may be defined by an aperture in the cuff formation.

The handle may be defined by a handle member which may include a handle portion and opposed extension portions extending internally along the cuff formation.

The opposed portions of the tubular member may be folded along a fold line and each free portion of the panel may extend beyond the fold line and may be secured to the tubular member beyond the fold line.

Each free portion of the panel may be secured to the tubular member to define a cuff formation.

The bag may further include a handle on each cuff formation.

Each handle may be defined by an aperture in one of the cuff formations.

Each handle may be defined by a handle member which may include a handle portion and opposed extension portions extending internally along the cuff formations.

A method of forming a bag, the method including:

providing a tubular member having an open mouth at least one end;

closing the open mouth; and forming at least one cuff formation at the end.

Forming the at least one cuff formation at the end may include forming two opposed cuff formations at the end. The method may further include forming a handle on the, or each, cuff formation. Forming the handle on the, or each, cuff formation may include forming an aperture in the, or each, cuff formation. Forming the handle on the, or each, cuff formation may include securing a handle member to the, or each, cuff formation. Closing the open end of the tubular member may include folding first opposed portions of the tubular member across the mouth, folding second opposed portions of the tubular member over the first opposed portions and securing the opposed portions together.

A bag including:

a tubular member having at least one closed end; and at least one cuff formation at the end.

The bag may include two cuff formations at the end. The bag may include a handle on the, or each, cuff formation. The handle may include an aperture in the, or each, cuff formation. The handle may include a handle member secured on the, or each, cuff formation. First opposed portions of the tubular member and second opposed portions of the tubular member may be secured together to form the closed end.

EMBODIMENT OF THE INVENTION

The invention will now be described, by way of example, with reference to the accompanying diagrammatic drawings, in which:

FIG. 8 shows a schematic three-dimensional view of an open end of a tubular member being closed to form a bag in accordance with another aspect of the invention;

FIG. 9 shows a schematic plan view along arrow VIII in FIG. 8 after opposed portions of the tubular member have been folded toward each other to form a base;

FIG. 10 shows a schematic side view along arrow IX in FIG. 9 after opposed peripheral portions at the base have been formed into cuff formations;

FIG. 11 shows a schematic side view corresponding to FIG. 10, the cuff formations being shown in positions to serve as handles;

FIG. 12 shows a schematic plan view of a block bottom bag in accordance with the invention;

FIG. 13 shows a schematic plan view of a base, or bottom, of a block bottom bag in accordance with the invention, the block bottom bag having a handle arrangement in accordance with the invention;

FIG. 13B shows a schematic side view of one embodiment of a block bottom bag corresponding to the block bottom bag of FIG. 13;

FIG. 13C shows a schematic side view of another embodiment of a block bottom bag corresponding to the block bottom bag of FIG. 13;

FIG. 14 shows a schematic plan view of a base, or bottom, of a block bottom bag in accordance with the invention, the block bottom bag having an integrated cloth handle arrangement in accordance with the invention;

FIG. 14B shows a schematic side view of the block bottom bag of FIG. 14;

FIG. 15 shows a schematic plan view of a base, or bottom, of a block bottom bag in accordance with the invention, the block bottom bag having a handle member arrangement in accordance with the invention; and FIG. 15B shows a schematic side view of the block bottom bag of FIG. 15.

Figure 1:
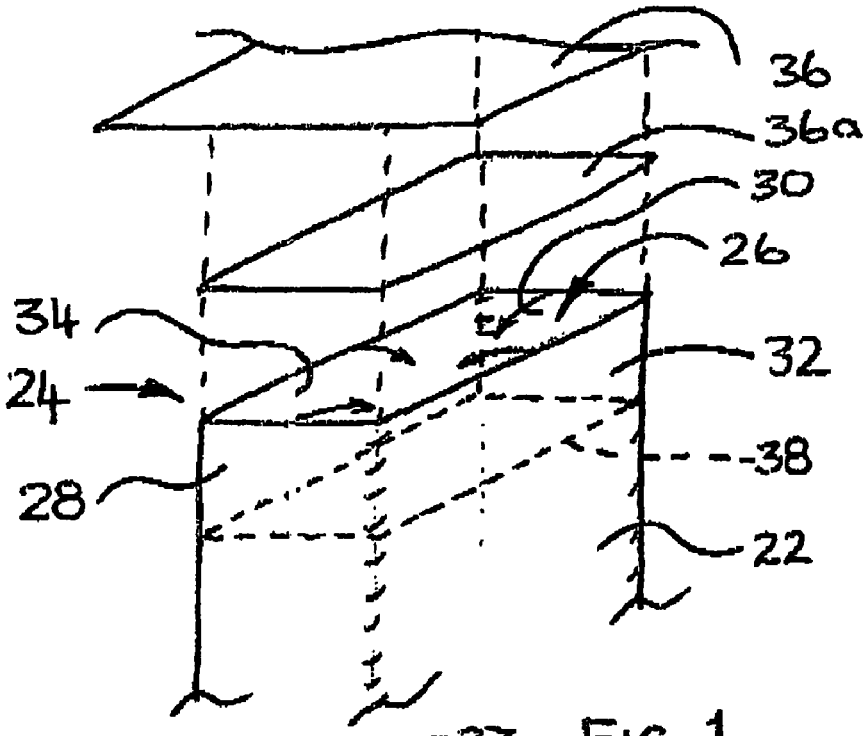
FIG. 1 shows a schematic three-dimensional view of an open end of a tubular member being closed to form a bag in accordance with one aspect of the invention.
Figure 2:
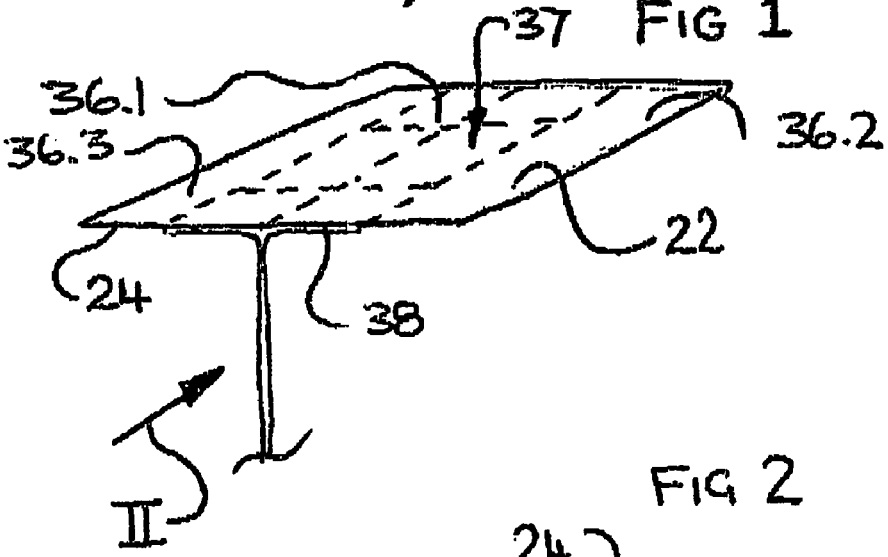
FIG. 2 shows a schematic three-dimensional view of the tubular member shown in FIG. 1, the tubular member being in a laterally collapsed condition.
Figure 3:
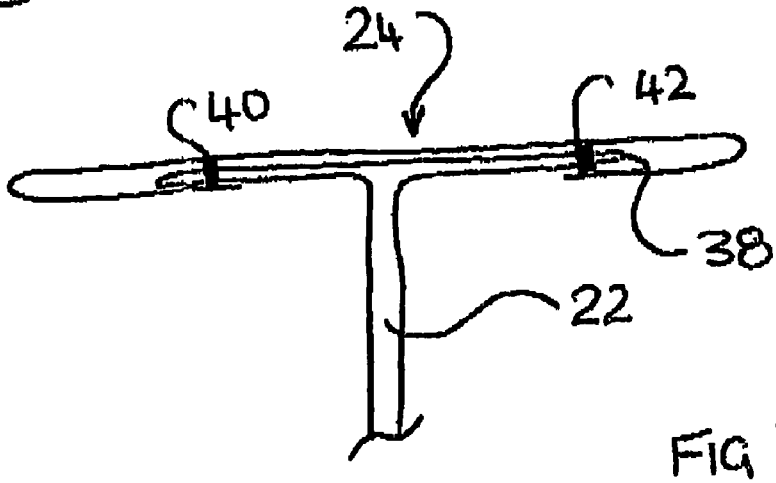
FIG. 3 shows a schematic side view of the tubular member of FIG. 2 along arrow II in FIG. 2.
Figure 4:
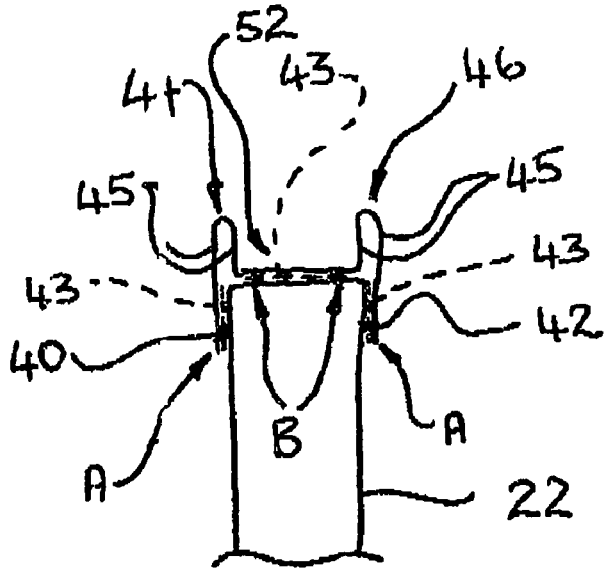
FIG. 4 shows a schematic side view of the tubular member of FIG. 3, free portions of a panel having been secured to the tubular member.

Referring to FIGS. 1 to 3 of the drawings, a bag is formed from a tubular member 22. The tubular member 22 has two opposed ends, one of which is generally indicated by reference numeral 24. The tubular member 22 has an open mouth 26 at the end 24.

To form the bag, first opposed portions 28, 30 of the tubular member 22 are folded to extend at least partially across the mouth 26. Typically, thereafter, other opposed portions 32, 34 of the tubular member 22 are folded to extend across the first opposed portions 28, 30. It will be appreciated that portions 32, 34 can be folded first followed by portions 28, 30.

A panel 36 is then positioned to extend across the portions 28, 30, 32, 34. The panel 36 and the portions 28, 30, 32, 34 are then secured together to close the mouth 26 and to form a base, or block bottom 37, of the bag 20, as can be seen in FIG. 2 of the drawings. The panel 36 and the portions 28, 30, 32, 34 are typically secured together by using an adhesive or paste, by welding, by sewing, or the like. The panel 36 and the portions 28, 30, 32, 34 are secured together such that a generally middle portion 36.1 of the panel 36 is secured to the portions 28, 30, 32, 34 and two opposed free portions 36.2, 36.3 of the panel 36 are free of the opposed portions 28, 30, 32, 34.

Optionally, an intermediate panel **36*a* can first be secured to the portions 28, 30, 32, 34 to secure the portions 28, 30, 32, 34 together. The panel 36*a* and the portions 28, 30, 32, 34 can typically be secured together by using an adhesive or paste, by welding, by sewing, or the like. The panel 36 can then be secured to the panel 36*a*** by using an adhesive or paste, by welding, by sewing, or the like.

The opposed portions 28, 30, 32, 34 of the tubular member 22 are folded along a fold line generally indicated by reference numeral 38. Each free portion 36.2, 36.3 of the panel 36 extends beyond the fold line 38. Each free portion 36.2, 36.3 of the panel 36 is folded and secured to the tubular member 22 beyond the fold line 38. The free portions 36.2, 36.3 of the panel 36 can be secured at seams 40, 42 by means of sewing, or welding, or the like. Instead, or in addition, an adhesive, or paste, can be used as indicated at 43. In this way, opposed hem or cuff formations 44, 46 are defined. It will be appreciated that the cuff formations 44, 46 include a double layer of material as indicated at 45.

Figure 5:
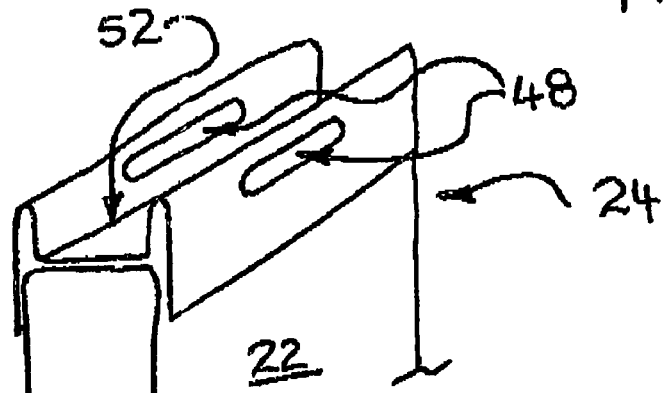
FIGS. 5 to 7 show schematic three-dimensional views corresponding to FIG. 4 and show different handle formations of the bag formed in accordance with the method of the invention.
Figure 6:
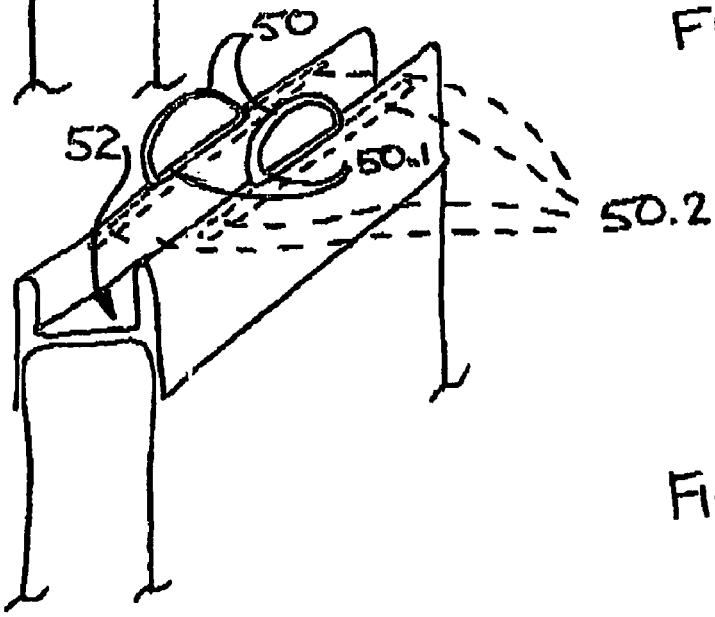

A handle can be formed on each cuff formation 44, 46. The handle can be formed by forming an appropriately shaped aperture 48, 48 in each cuff formation 44, 46, as can best be seen in FIG. 5. The apertures 48, 48 can be formed in any appropriate manner, such as by punching, cutting, or the like. Instead, the handle can be formed by securing a handle member, generally indicated by reference numerals 50, 50, to each cuff formation 44, 46, as can best be seen in FIG. 6. Each handle member 50 can include a handle portion 50.1 and opposed extension portions 50.2, 50.2. Each handle member 50 can be secured to its associated cuff formation 44, 46 by positioning each handle member 50 such that the extension portions 50.2, 50.2 extend internally along its associated cuff formation. It will be appreciated that the handles of FIGS. 5 and 6 have enhanced strength because the cuff formations are secured at opposed positions and act in two directions at A and B.

Figure 7:
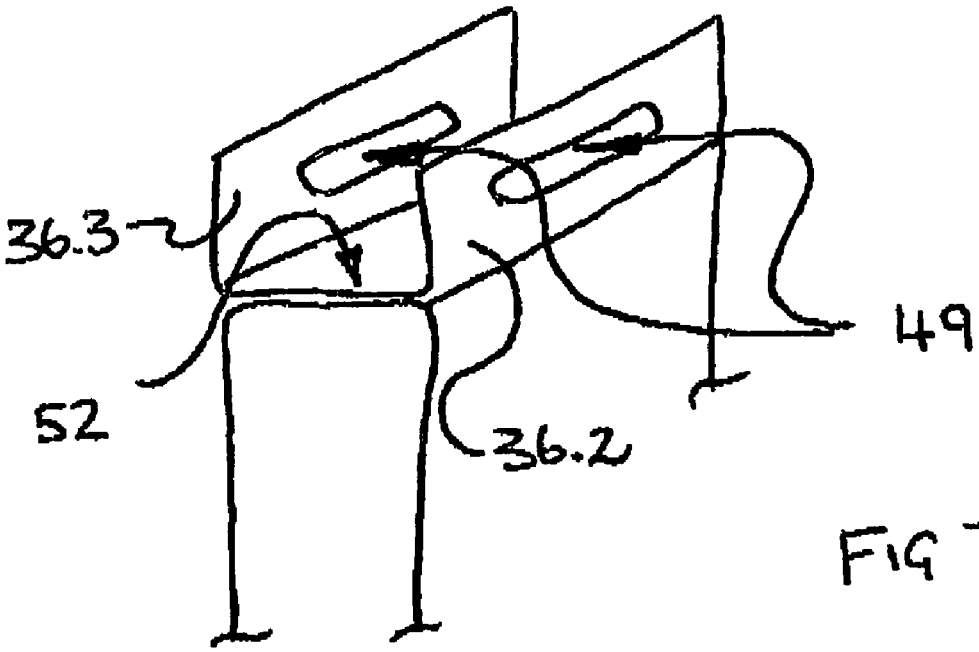

In FIG. 7, another bag 50 has been formed in accordance with the method of the invention. The bag 50 is similar to the bag shown in FIG. 5 accept that the free portions 36.2, 36.3 are left free of the tubular member 22. Apertures 49, 49 can then be formed in the portions 36.2, 36.3 to define handles of the bag 50.

It will be appreciated that the bags shown in FIGS. 4 to 7 have closed ends at 52. In use, the bags are typically used to contain material. The bags are typically cut to provide access to material contained in the bags. Once the bags are emptied of their contents, the bags can typically be used for other purposes, such as for carrying articles, material, or the like. It will further be appreciated that the tubular member 22 can be closed at the end not shown in FIGS. 1 to 7, in which case the tubular member is in the form of a bag having an open mouth similar to that shown in FIG. 1, which bag can be a bag of the block bottom valve type. Naturally, the bag of the invention can be filled through the open mouth 26 shown in FIG. 1 before the mouth 26 is closed as described above. Instead, the tubular member 22 can have an opposed open end through which it can be filled after the mouth 26 is closed as described above. A filled bag formed in accordance with the invention can then conveniently be carried around by using the handles. The bag can be of a woven plastic material, a plastic film, paper, or the like.

Although the formation of the bag has been described with reference to the bag having two handles, it is to be appreciated that the bag can be formed to have one handle only.

Referring now to FIGS. 8 to 11, the formation of a bag in accordance with another aspect of the invention will now be described.

As can best be seen in FIG. 8, the bag is formed from a tubular member 122. The tubular member 122 has an open mouth 124. To close the mouth 124, opposed portions 126, 128 of the tubular member 122 are folded to extend across the mouth 124. Other opposed portions 130, 132 are then folded to extend across the folded portions 126, 128, as can best be seen in FIG. 9. Typically, the portions 130, 132 are folded to overlap at 134. The portions 126, 128, 130, 132 are then secured together to close the mouth 124 and to form a base. The base is typically a block bottom base 133. The portions 126, 128, 130, 132 can be secured together in any appropriate manner, such as by using heat, sound, an adhesive or paste, or the like. Conveniently, a support 136 can be positioned in the tubular member 122 to act as a support during the folding of the portions 126, 128, 130, 132 and the securing of the portions 126, 128, 130, 132 together. The support 136 can either be left in the tubular member 122 to form part of the bag when formed, or can be removed after the portions 126, 128, 130, 132 have been folded and secured together. The support 136 can be of metal or any other appropriate material. Where the support 136 is to be removed from the tubular member after the portions 126, 128, 130, 132 have been folded and secured together, an appropriate separation layer may be provided on the support to inhibit the portions 126, 128, 130, 132 from sticking thereto.

Referring now to FIGS. 10 and 11, opposed peripheral portions at the base 133 are formed into cuff formations 138, 140. The cuff formations 138, 140 can be formed in any appropriate manner, such as by using heat, sound, an adhesive or paste, or the like. It will be appreciated that the cuff formations 138, 140 have a double layer of material 142, 142. A handle can then be formed on the cuff formations 138, 140 in a fashion similar to that described above with reference to FIGS. 5 to 7. It will be appreciated that the handles are formed in the cuff formations such that the closure of the bag is not compromised. In this way, a closed end of a bag can be formed such that the closed end defines relatively strong formations on which handles can be formed.

In use, the bag is typically used to contain material. The bag is typically opened by cutting at 146 as shown in FIGS. 10 and 11. The bag can be carried by the handles after having been opened and can typically be used as a carry bag, or the like, after its contents have been emptied. The bag can be of a woven plastic material, a plastic film, paper, or the like.

Various embodiments of bags in accordance with the invention will now be described with reference to FIGS. 12 to 15 of the drawings.

In FIG. 12, reference numeral 15 indicates a folded, pasted, welded or glued block bottom bag formed in accordance with the invention.

In FIGS. 14, 14B, 15 and 15B, reference numeral 11 indicates a closed separate area or cavity of the bag. The cavity can be in the form of a cuff formation.

In FIGS. 14, 14B, 15 and 15B, reference numeral 11*b* indicates a weld, or welded area of the bag. It will be appreciated that instead of a weld, or welded area, reference numeral 11*b* can indicate an adhered, or sewed, or stitched line or area.

In FIGS. 13 and 14, reference numerals 10 indicate apertures arranged to serve as handles. The apertures can be formed by punching, or the like.

In FIGS. 13, 13B, 14, 14B, 15 and 15B, reference numerals 16 indicates an area of the bag. This area is typically cut to open the bag thereby to provide access to material contained in the bag.

In FIG. 13, reference numerals 13 indicate holes or cavities within the closed area as described above.

In FIG. 13B, reference numerals 14 indicate welding, sewing or pasting in this area so that when the bag is lifted the handle provides strength in two directions.

In FIG. 13B, reference numerals 11B indicate welding, sewing or pasting in this area.

In FIGS. 13B, 13C, 14B and 15B, reference numerals 17 indicate the main area of the bag.

In FIGS. 15 and 15B, reference numeral 16 indicates an area of the main bag, which, if cut, will open the bag.

The current invention relates to a method and process of manufacturing a package, and/or, bag with a handle. The package and/or bag can also be manufactured to be closed at one or both ends with a built in handle.

According to a first aspect of the invention there is provided a process for the manufacture of a bag or container from a woven plastic material, a plastic film, paper, or the like, with the use of a machine. The process can also be performed manually. The bag can be a block bottom bag. According to a second aspect of the invention, there is provided a process for closing a bag or container at defined positions by means of heat welding, sewing, sound, or the like, by an automated process or by hand. According to a third aspect of the invention there is provided a process for forming a handle using bag material, and/or a separate piece of material and/or insertion of an object to act as a handle.

In one embodiment, a container is manufactured according to the first aspect of the invention. According to the second aspect of the invention a strip of material used to close or create the bottom and/or top of the bag used in forming the cover piece to secure one or two ends of the said bag. The said strip is of a width greater than that of the block bottom size, the section formed at one or more ends. The said strip of material can be folded and then pasted, welded or sewn to the bottom section of the T that is formed if the bag is looked at from a side view block bottom, that is created in the forming of the bag, that will create a double layer of material, a hole that will be used as the handle can then be introduced. The bag constructed in such a manner will give the handle strength in two directions, as the bonding, or weld can be weak in one of the directions. Alternatively, this strip can be left unfolded and used as the handle. It is understood that this is a closed end, or bag. The said bag can be of an open mouth type, or valve. When the said bag is of the open mouth type it can be filled then closed. Once the bag is filled it can then be picked up by the two handles. It is to be understood that the material between the sewn portions that are the handles, will be cut so as to allow access to the product contained in the bag, and once the said product is used or the bag emptied, the bag can then be used for some other means.

In another embodiment, a container is manufactured according to the first aspect of the invention. According to the second aspect of the invention a strip of material used to close or create the bottom and/or top of the bag, used in forming the cover piece to secure one or two ends of the said bag. A second strip, of a width greater than that of the block bottom size, is pasted, welded or sewn to the section that has formed the block bottom at one or more ends.

In another variant of the said process the bottom layers may be folded in on themselves to cover a protective unit so that the said folded portion does not rest directly on themselves but on the protective unit. This unit can be made of a metal or any other solid material. The top layer can then be folded in on itself to cover the folded bottom portion of the fabric that is resting on a separating material in the said process. Where the two layers overlap there is a device that causes the two materials to bond, either by heat, sound, glue, or any other means. At a given position the two adjacent folded layers are bonded together by any of the above means. The bonded portion becomes a double-layered portion of the said package, or bag. A handle can be attached to this portion of the unit, or a handle can be introduced by means of punching a hole or slot to the said double layer of material. The said handle would be in an area above the bonded portion if the bag is to be bonded at a specific position or would fall into an area that is bonded but would not allow any of the contents of a filled package to escape when in any position. Thus it is said that the bag can have at least one end, two reinforced or double layers of fabric that will be suitable for imbedding a handle or a attaching a device that will serve as a handle. It will also be understood that at least one end of the said bag would be closed and that at this position there would be one or two of the said handles. It will also be understood that at this position a portion of the material can be cut to open the said bag and to have at least two handles to carry the said bag with an open mouth. It is envisaged that this bag, once the contents have been emptied can be further used for other means. It will be understood that this manufacturing process can be in stages or can be in a continuous process. It will be understood that this process can be automated (made by a machine) but can also be done by a person.

The inventor envisages a future process in the manufacture of the said container or bag as to the automated process in the construction of a block bottom valve bag or container and is understood as the invention.

The invention claimed is:

1. A method of closing an end of a bag during its manufacture, the method including:

starting with an elongate tubular member having opposed ends, at least one end of which defines an open mouth, forming a folded portion comprising folding opposed portions of the tubular member to extend at least partially across the mouth;

positioning a panel to extend across the folded portion so that a main portion of the panel covers the folded portion and a remainder portion extends beyond the folded portion; and securing the main portion of the panel and the folded portion together thereby to form closure for the mouth;

forming a handle for the bag using the remainder portion of the panel; wherein the handle is integral with the closure.

2. The method as claimed in claim 1, wherein forming the handle comprises forming an aperture in opposed portions of the remainder portion thereby to define opposed handles.

3. The method as claimed in claim 1, further comprising securing at least some parts of the remainder portion to the tubular member.

4. The method as claimed in claim 3, wherein securing the remainder portion of the panel to the tubular member includes forming a cuff formation.

5. The method as claimed in claim 4, wherein forming the handle comprises forming it on the cuff formation.

6. The method as claimed in claim 5, wherein forming the handle on the cuff formation includes forming an aperture in the cuff formation.

7. The method as claimed in claim 5, wherein forming the handle on the cuff formation includes securing a handle member to the cuff formation.

8. The method as claimed in claim 7, wherein the handle member includes a handle portion and opposed extension portions, securing the handle member to the cuff formation then including positioning the handle member such that the extension portions extend internally along the cuff formation.

9. A method of forming a closure for one end of a bag during its manufacture, the method including:

starting with a tubular member having an open mouth at one end, closing the open mouth by folding opposed portions of the tubular member to define a folded portion that that extends at least partially across the mouth; securing a panel to the folded portion to form a the closure; wherein at least a remainder portion of the panel extends beyond the folded portion; and forming at least one cuff formation in the remainder portion such the cuff portion is integral with the closure.

10. The method as claimed in claim 9, wherein forming at least one cuff formation comprises forming two opposed cuff formations.

11. The method as claimed in claim 9, which further includes forming a handle on the, or each, cuff formation.

12. The method as claimed in claim 11, wherein forming the handle on the, or each, cuff formation includes forming an aperture in the, or each, cuff formation.

13. The method as claimed in claim 11, wherein forming the handle on the, or each, cuff formation includes securing a handle member to the, or each, cuff formation.

* * * * *